US006712670B2

(12) United States Patent
de la Llera et al.

(10) Patent No.: US 6,712,670 B2
(45) Date of Patent: Mar. 30, 2004

(54) METHOD AND APPARATUS FOR APPLYING DOWNWARD FORCE ON WAFER DURING CMP

(75) Inventors: Anthony de la Llera, Union City, CA (US); Xuyen Pham, Fremont, CA (US); Andrew Siu, Union City, CA (US); Tuan A. Nguyen, San Jose, CA (US); Tony Luong, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 31 days.

(21) Appl. No.: 10/033,671

(22) Filed: Dec. 27, 2001

(65) Prior Publication Data

US 2003/0139115 A1 Jul. 24, 2003

(51) Int. Cl.[7] ..... B24B 49/00

(52) U.S. Cl. ..... 451/11; 451/19; 451/24; 451/307

(58) Field of Search ..... 451/6, 5, 8, 9, 451/10, 11, 24, 41, 276, 285, 288, 290, 296, 303, 307, 385, 398

(56) References Cited

U.S. PATENT DOCUMENTS

| | | | | | |
|---|---|---|---|---|---|
| 5,613,901 | A | * | 3/1997 | Weber et al. | 451/303 |
| 5,762,536 | A | * | 6/1998 | Pant et al. | 451/6 |
| 5,916,009 | A | * | 6/1999 | Izumi et al. | 451/5 |
| 6,358,114 | B1 | * | 3/2002 | Walker et al. | 451/5 |
| 6,439,978 | B1 | * | 8/2002 | Jones et al. | 451/168 |

* cited by examiner

*Primary Examiner*—Joseph J. Hail, III
*Assistant Examiner*—Anthony Ojini
(74) *Attorney, Agent, or Firm*—Martine & Penilla, LLP

(57) ABSTRACT

An apparatus for applying a wafer to a polishing belt during a CMP operation includes a spindle having an upper end and a lower end. A wafer carrier is coupled to the lower end of the spindle. A linear force generator is disposed at the upper end of the spindle. A load cell is positioned between the linear force generator and the upper end of the spindle. A controller is coupled to the load cell for controlling the force applied by the linear force generator. A method for applying downward force on a wafer during CMP also is described.

10 Claims, 6 Drawing Sheets

120'
138
122
136
144
121
132
124
146
130
148
126

METHOD AND APPARATUS FOR APPLYING DOWNWARD FORCE ON WAFER DURING CMP

BACKGROUND OF THE INVENTION

The present invention relates to chemical mechanical planarization (CMP) techniques and, more particularly, to a method for applying downward force on a wafer during CMP and an apparatus for applying a wafer to a polishing surface during a CMP operation.

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly in respect to the surface of the wafer 16. The belt 12 is a continuous belt rotating about rollers 20. The rollers are typically driven by a motor so that the rotational motion of the rollers 20 causes the polishing belt 12 to be driven in a linear motion 22 with respect to the wafer 16.

The wafer 16 is held by a polishing head 18. The wafer 16 is typically held in position by mechanical retaining ring and/or by vacuum. The polishing head 18 positions the wafer atop the polishing belt 12 and moves the wafer 16 down to the polishing belt 12. The polishing head 18 applies the wafer 16 to the polishing belt 12 with pressure so that the surface of the wafer 16 is polished by a surface of the polishing belt 12. The polishing head 18 is typically part of a spindle drive assembly 30 (shown in FIG. 1B) that enables application of polishing pressure to the wafer 16.

FIG. 1B shows a conventional spindle drive assembly 30 that may be utilized to apply the wafer 16 to the polishing belt in the CMP apparatus 10 (as shown above in FIG. 1A). The spindle drive assembly 30 includes the polishing head 18 connected to a spindle 42. The spindle 42 is attached to a force magnifier 34 that in one end is connected to a hinge 40 and in the other end is connected to an air cylinder 32. The force magnifier 34 is typically an a machined aluminum arm that acts in a similar manner to a lever so force applied by the air cylinder 32 is magnified onto the spindle 42. The spindle 42 then pushes down the polishing head 18 which in turn applies pressure to the wafer 16 for polishing action (as shown in FIG. 1A).

Generally, a range of 3 psi to 10 psi can be applied to the wafer 16 by the spindle drive assembly 30. Unfortunately, at pressures lower than 3 psi, the by the spindle drive assembly 30 is unable to apply a consistent, controlled pressure. The air cylinder 32 is typically controlled with a pneumatic servo valve that uses feedback from a load cell 36 inside the polishing head 18. Problematically the weight of the spindle, head, and other hardware is not supported by anything other than the spindle. This makes the application of downward forces lower than the weight attached to the cylinder 32 very unstable. Also, because of the force magnifier 34, small adjustments in pressure made at the cylinder 32 cause large pressure application changes in the polishing head 18 so control of pressure is very difficult. In certain circumstances, the inability to control low force application prevents a gentle touchdown of the wafer onto the polishing pad. This often occurs because of an inherent overshoot built into the spindle drive assembly 30 for a particular pressure setting. For example, if pressure of 4 psi is desired to be applied to the wafer, a pressure of 5 psi is generally applied to break friction within individual components of the spindle drive assembly 30 and move the spindle. Therefore, low polishing pressure application to the wafer using conventional pressure application systems is very problematic.

Additionally, because of the indirect linkage of air cylinder 32 to the rest of the spindle drive assembly 30, reduced stability of the polishing head 18 often occurs. Therefore, consistent polishing pressure on a wafer, especially at low pressure levels is often difficult to attain.

Therefore, there is a need for an apparatus that overcomes the problems of the prior art by having a downward force application apparatus that can optimize control of polishing pressure applied by a polishing head to a wafer in CMP systems.

SUMMARY OF THE INVENTION

Broadly speaking, the present invention fills this need by enabling the optimal control of downward force application in a chemical mechanical planarization (CMP) polishing process. It should be appreciated that the present invention can be implemented in numerous ways, including as a process, an apparatus, a system, a device or a method. Several inventive embodiments of the present invention are described below.

In accordance with one aspect of the invention, an apparatus for applying a wafer to a polishing surface during a CMP operation is provided. The apparatus includes a spindle that has an upper end and a lower end. A wafer carrier is coupled to the lower end of the spindle. A linear force generator is disposed at the upper end of the spindle. A load cell is positioned between the linear force generator and the upper end of the spindle. A controller is coupled to the load cell for controlling the force applied by the linear force generator.

In one embodiment, the linear force generator includes a lower plate that is disposed on the load cell and an upper plate supported above the lower plate. The linear force generator also includes a bladder positioned between the lower plate and the upper plate. In another embodiment, a load cell plate is coupled to the upper end of the spindle, and a load cell is disposed on the load cell plate.

In accordance with another aspect of the invention, a method for applying downward force on a wafer during chemical mechanical planarization (CMP) is disclosed. In this method, a linear downward force is applied to an upper end of a spindle. The spindle has a wafer carrier coupled to a lower end thereof. The method also monitors the linear downward force applied on the upper end of the spindle.

The advantages of the present invention are numerous. Most notably, by creating an apparatus that is configured to optimally control and apply linear downward force onto a wafer, control over polishing pressures utilized in CMP may be significantly improved. Specifically, a force generation assembly may be connected to an upper end of the spindle, and the lower end of the spindle may be connected to a wafer carrier. This structure enables direct linear application of force to a wafer. In this way, the range of consistent force application may be expanded and low force application to the wafer can be enhanced. In addition, the force application apparatus described herein augments wafer carrier stability which even further optimizes wafer processing. Consequently, the force application apparatus enables highly advantageous wafer polishing pressure control and improved wafer processing efficiency.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Figure 1A:
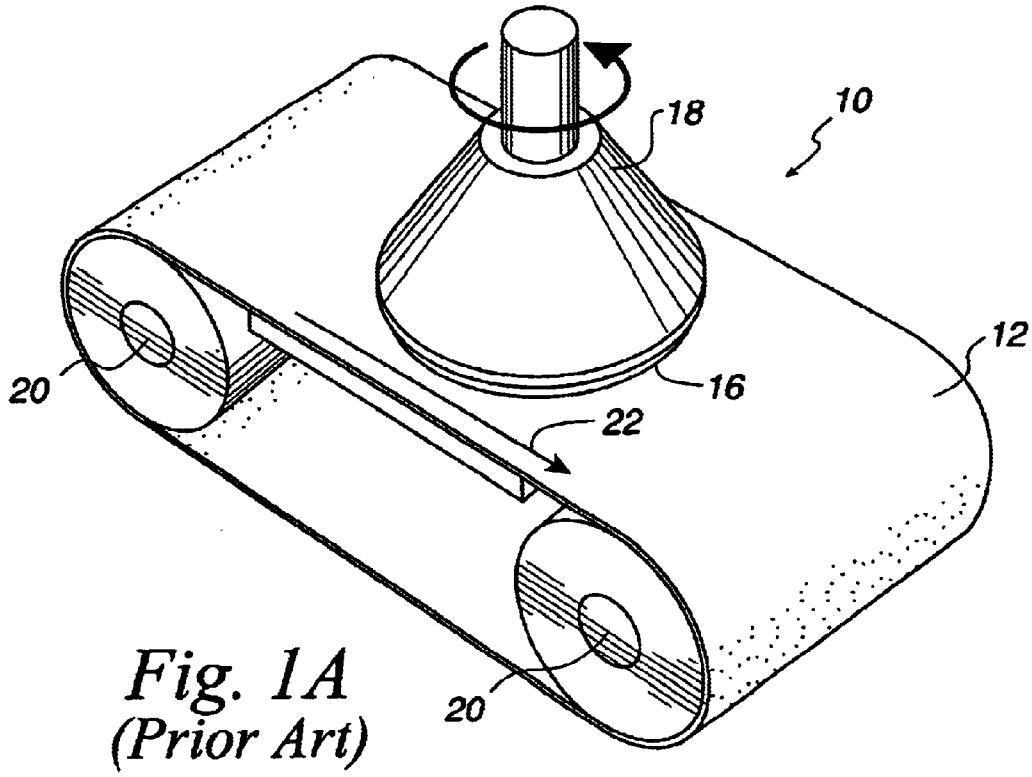
Fig. 1A (Prior Art)
FIG. 1A shows a linear polishing apparatus which is typically utilized in a CMP system.
Figure 1B:
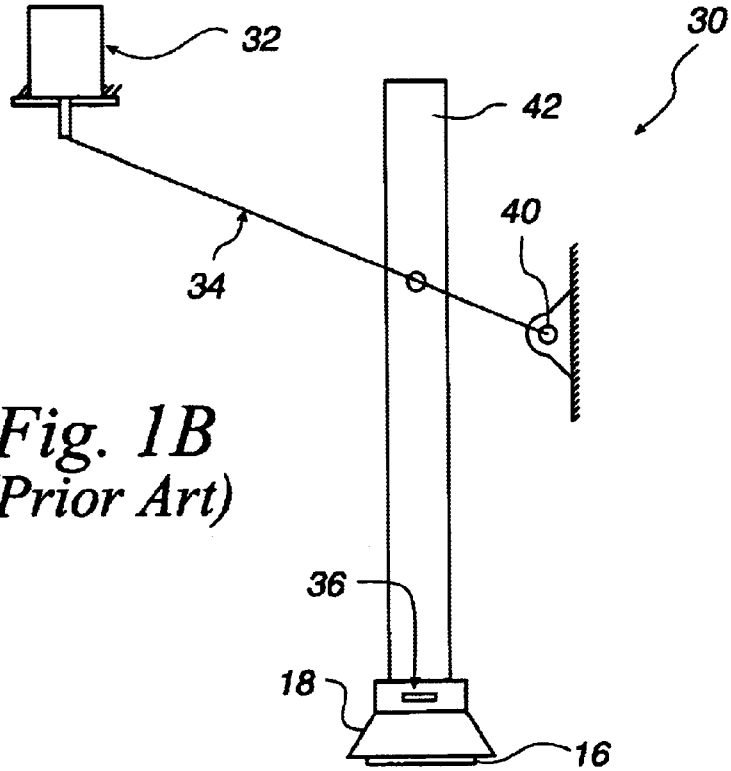
Fig. 1B (Prior Art)
FIG. 1B shows a conventional spindle drive assembly that may be utilized to apply the wafer to the polishing belt in the CMP apparatus (as shown above in FIG. 1A).

Several exemplary embodiments of the invention will now be described in detail with reference to the accompanying drawings. FIGS. 1A and 1B are discussed above in the "Background of the Invention" section. It should be appreciated that although the following embodiments describe an apparatus applying downward force, the following embodiments may be inverted so upward force is applied. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

Figure 2A:
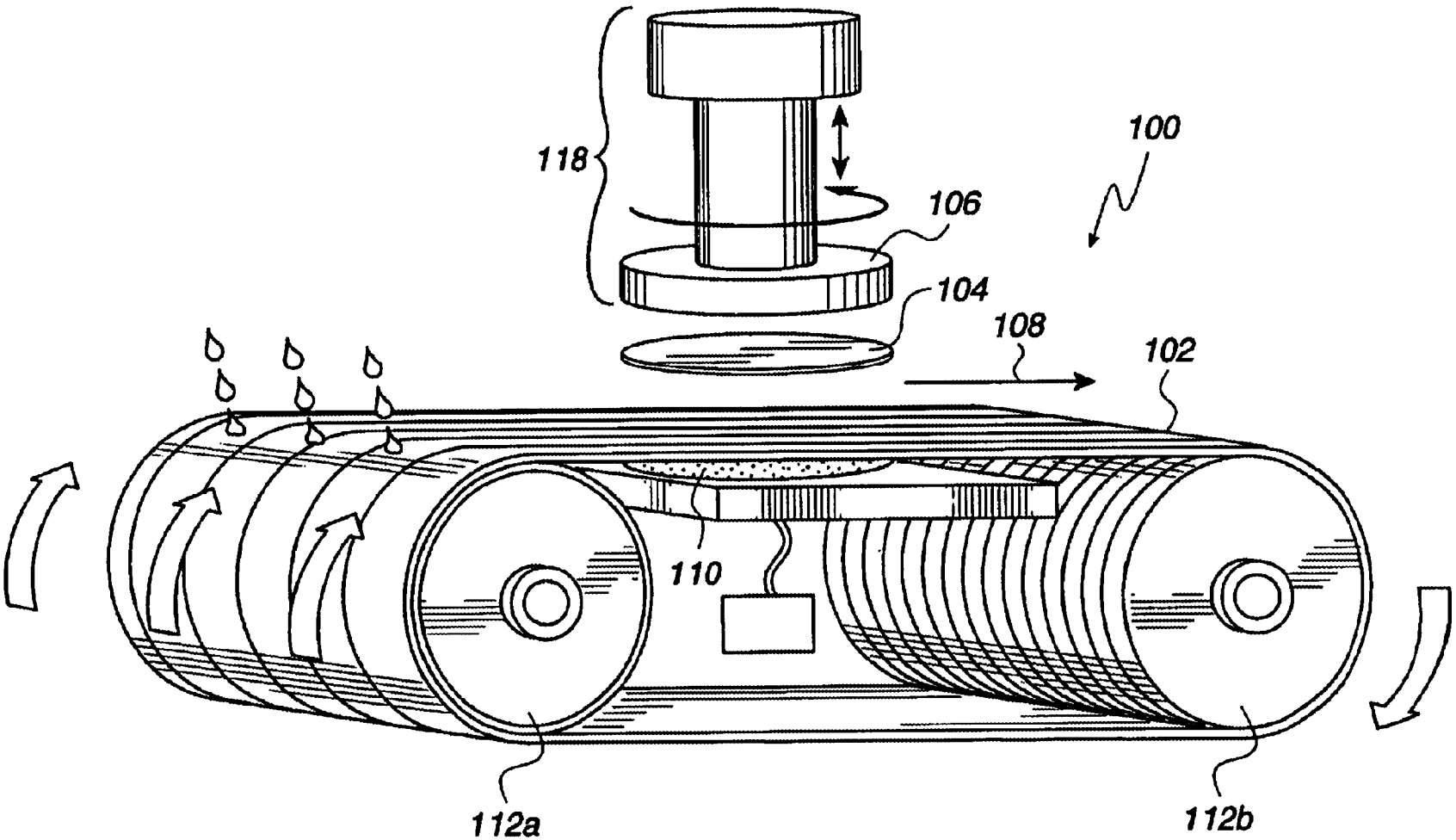
FIG. 2A shows a CMP system according to one embodiment of the present invention.
Figure 2B:
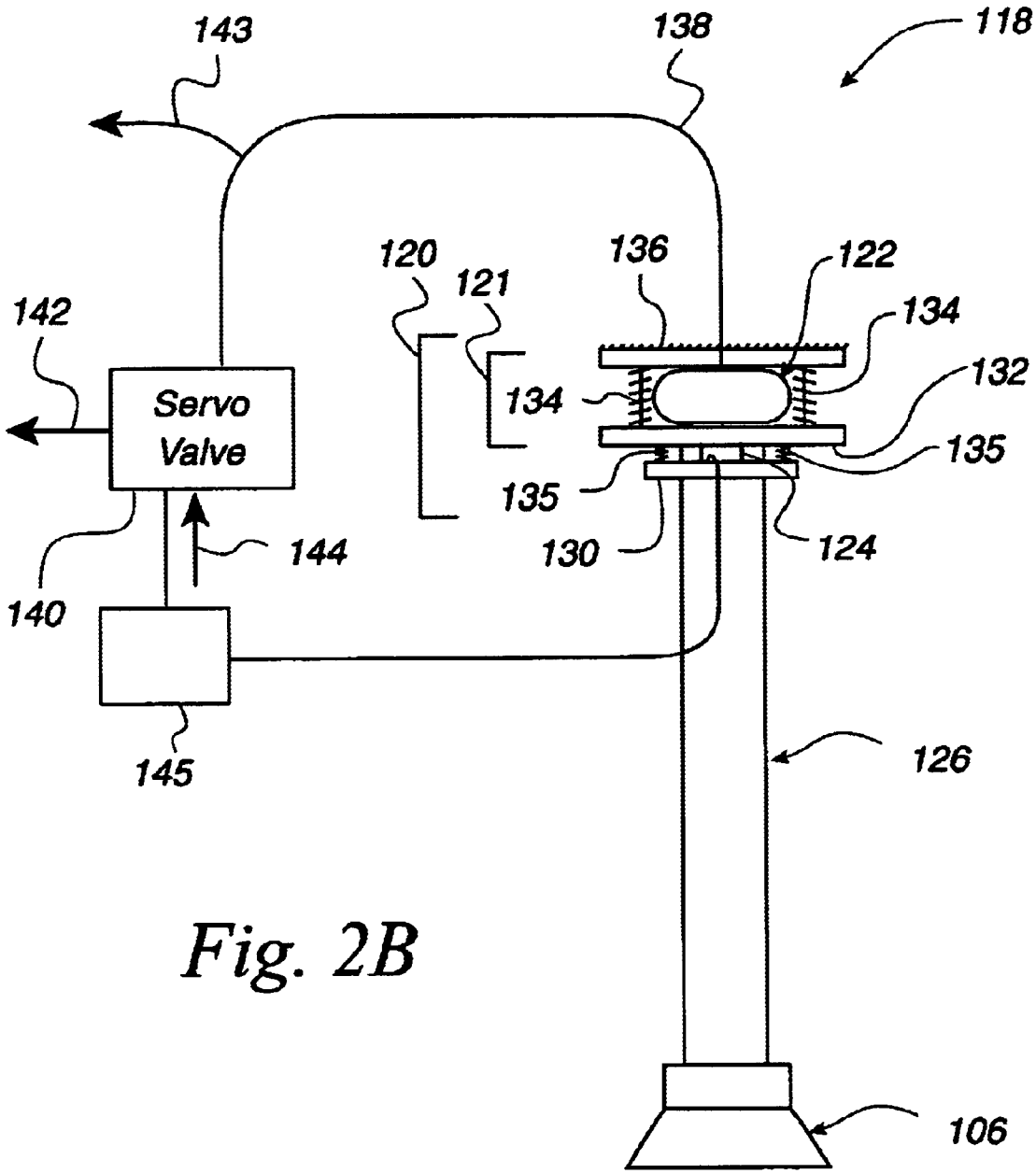
FIG. 2B shows the force application assembly in accordance with one embodiment of the present invention.

FIG. 2A shows a chemical mechanical planarization (CMP) system 100 according to one embodiment of the present invention. A carrier head 106 that is a part of a force application assembly 118 (as shown in FIG. 2B) may be used to secure and hold the wafer 104 in place during wafer polishing operations. A polishing belt 102 forms a continuous loop around rotating drums 112*a* and 112*b*. It should be appreciated that the polishing belt 102 may be any suitable type of structure such as, for example, a single layer polishing pad, a polishing pad supported by a stainless steel layer, a multilayer polishing structure (e.g., a polishing pad over a cushioning layer which is in turn over a stainless steel layer). It should also be appreciated that the principles described herein also apply to non-belt CMP devices, e.g., rotary devices. The polishing belt 102, in one embodiment, is a single layer polyurethane polishing pad utilized in linear CMP systems. The polishing belt 102 generally rotates in a direction indicated by a direction 108 at a speed of about 400 feet per minute. Although, this speed does vary depending upon the specific CMP operation.

As the belt 102 rotates, polishing slurry may be applied and spread over the surface of the polishing belt 102. The carrier head 106 may then be used to lower the wafer 104 onto the surface of the rotating polishing belt 102. The force application assembly 118 is discussed in further detail in reference to FIG. 2B. A platen 110 may support the polishing belt 102 during the polishing process. The platen 110 may utilize any suitable type of bearing such as an air bearing. In this manner, the surface of the wafer 104 that is desired to be planarized is substantially smoothed in an even manner.

In some cases, the CMP operation is used to planarize materials such as copper (or other metals), and in other cases, it may be used to remove layers of dielectric or combinations of dielectric and copper. The rate of planarization may be changed by adjusting the polishing pressure. The polishing rate is generally proportional to the amount of polishing pressure applied by the carrier head 106 with the wafer 104 to the polishing pad against the platen 110. By effectively managing the polishing rate, the desired amount of material is removed from the surface of the wafer 104. When the polishing is complete the carrier head 106 may be used to raise the wafer 104 off of the polishing belt 102. The wafer 104 is then ready to proceed to a wafer cleaning system. Therefore stable and flexible application of downward force by the carrier head 106 is extremely important for efficient wafer production.

FIG. 2B shows the force application assembly 118 in accordance with one embodiment of the present invention. In this embodiment, the force application assembly 118 includes the wafer carrier 106 that is coupled to a lower end of a spindle 126 and a force generation assembly 120 connected to the upper end of the spindle 126. In one embodiment, the wafer carrier 106 is located below the force generation assembly 120 and the spindle 126 in a substantially direct vertical line. It should be understood that the spindle may be any suitable shape that that can couple the force generation assembly 120 to the wafer carrier 106. In one embodiment, the spindle 126 has a substantially cylindrical shape. The lower end of the spindle 126 is connected to the wafer carrier 106 and the upper end is connected to the force generation assembly 120. It should be appreciated that the spindle 126 may be any suitable dimension depending on the configuration desired for use within the CMP system 100.

The force generation assembly 120 as described herein includes components of the force applicator 118 located above the spindle 126. In one embodiment, the force generation assembly 120 may include components such as a load cell 124 and a bladder 122 and their accompanying structural components. In this embodiment, a bottom surface of a load cell plate 130 connects with the upper end of the spindle 126. The load cell plate 130 is coupled to springs 135 which in turn is coupled to a bottom surface of a lower plate 132. The load cell 124 is positioned between the load cell plate 130 and the lower plate 132. The springs 135 are utilized with rods that serve to pull the lower plate 132 onto the load cell 124. Therefore, the load cell 124 is mounted on the load cell plate 130, under constant pressure, as part of the supported weight of the force application assembly 118. In one embodiment, the load cell 124 detects between about 100 pounds of force to about 150 pounds of force. A top portion of the load cell 124 is coupled to a bottom surface of a lower plate 132. Springs 134 are attached to the lower plate 132 and a upper plate 136. The bladder 122 is located between the lower plate 132 and the upper plate 136. The springs 134 are utilized with rods to retract the lower plate 132 onto the bladder 122 so when air is released from the bladder 122, the springs 134 retract the lower plate 132 towards the upper plate 136. A bladder spacer 144 enables maintenance of a minimum space between the upper plate 136 and the lower plate 132. The structure that includes the upper plate 136, the lower plate 132 and the bladder 122 is herein referred to as a linear force generator 121 that is disposed at the upper end of the spindle 126, and the load cell 124 is positioned between the linear force generator 121 and the upper end of the spindle 126. It should be understood that linear force generator 121 as described herein includes two plates, a bladder, and associated components, but could be any type of suitable device that can provide pressure or force in a controllable manner such as, for example, motors, hydraulic devices, gears, etc. Because the springs 134 and 135 keep a constant retracting pressure on the components within the force generation assembly 120, once force is applied, the load cell 124 only detects the force of the wafer carrier 106 against the polishing belt.

It should be understood that the bladder 122 may utilize any suitable gas or fluid to apply pressure to the wafer carrier 106. In one embodiment, clean, dry air is utilized to inflate the bladder 122. Any references to "air" utilized herein can be substituted with any suitable gas or fluid such as, for example, nitrogen, etc. An air line 138 connects to the bladder 122 through a hole within the upper plate 136. The air line 138 attaches to a servo valve 140 that manages air input and output to and from the bladder 122. The air line 138 is also attached to an quick exhaust device 143 which enables a fast release of air. It should be understood that the quick exhaust device 143 may be any suitable air releasing device such as, for example, a solenoid, a quick exhaust valve, etc. The servo valve 140 is connected to an input 144 (into the servo valve) and an output 142 (out of the servo valve). The servo valve 140 may be utilized as a gatekeeper for air input and output from the bladder 122. Optionally, a servo amplifier comparator 145 may monitor the amount of downward force detected by the load cell 124 that is utilized to control the servo valve 140 to set and/or maintain a certain amount of downward force air bladder applies on the spindle 126. The servo amplifier comparator 145 and the servo valve 140 may also herein be referred to as a controller. Therefore, the controller may be coupled to the load cell for controlling the force applied by the linear force generator 121. The operation of monitoring and applying downward force is further described in reference to FIG. 3.

When air is inputted into the bladder 122 from the servo valve 140, the bladder 122 increases in volume and expands. When the bladder 122 expands, it presses against the upper plate 136 and the lower plate 132. In one embodiment, the upper plate 136 may be stabilized so the upper plate 136 does not move when the bladder 122 expands. The lower plate 132 pushes down on the load cell 124 which transmits the downward force to the load cell plate 130. The load cell plate 130 transmits the downward force directly to the spindle 126. With use of the downward force, the spindle 126 is moved downward and pushes the wafer carrier 106 with a wafer against a polishing pad for wafer polishing operations. Therefore, in one embodiment, there is a transmission of a direct linear downward force applied from the bladder 122 to the wafer carrier which implements the wafer polishing.

The air pressure within the bladder 122 may be adjusted so that the air bladder applies a desired amount of force on the spindle. When air pressure in the bladder 122 is reduced, the springs 134 (which was expanded when air was inputted into the bladder 122) retracts thereby reducing force on the lower plate 132. When this happens the downward force applied to the wafer carrier 106 is reduced thereby reducing polishing pressure applied to a wafer in a CMP process. Because downward force is applied in a direct line without use of a force magnifier, small adjustments applied at the bladder 122 are transmitted in a direct linear manner to the wafer carrier 106. The force application assembly 118 enables stable application of pressure to the wafer at a greater range than conventional force application devices.

Figure 2C:
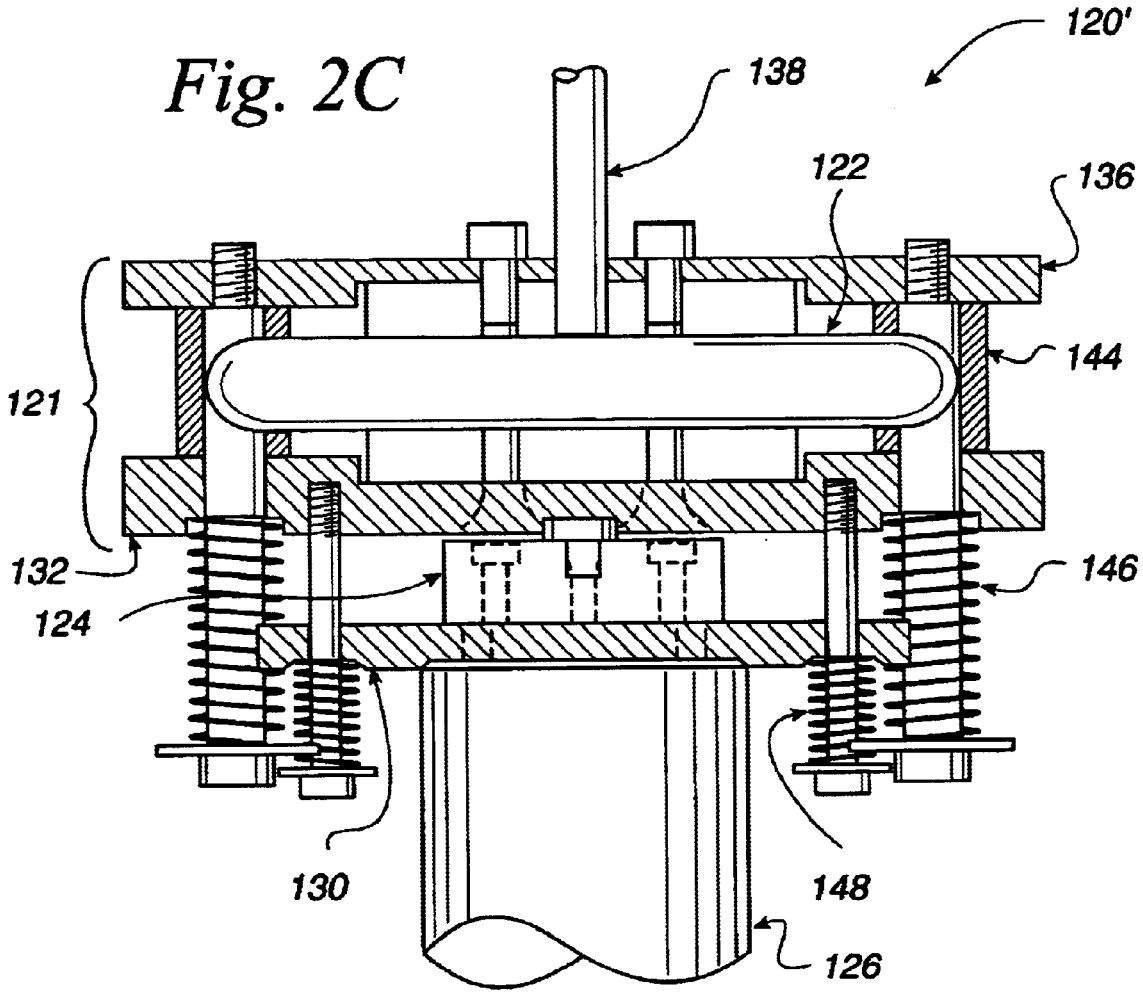
FIG. 2C shows a modified force generation assembly with an alternative retracting spring structure in accordance with one embodiment of the present invention.

FIG. 2C shows a modified force generation assembly 120' with an alternative retracting spring structure in accordance with one embodiment of the present invention. In this embodiment, the force generation assembly 120' has the load cell plate 130 that is connected to an upper end of the spindle 126. Load cell springs 148 are compression springs located below the load cell plate 130. The load cell springs 148 are connected with retracting rods which penetrate through the load cell plate 130 and are coupled to a lower plate 132. Through use of the compression springs 148, the retracting rods pull the lower plate 132 onto the load cell 124 located between the lower plate 132 and the load cell plate 130. Retracting springs 146 are located below the lower plate 132 and are connected to retracting rods that penetrate the lower plate 132 and are coupled to the upper plate 136. Through use of the compression springs 146, the retracting rods pull the upper plate 136 onto the bladder 122 located between the lower plate 132 and the upper plate 136. The bladder spacer 144 limits the compressibility of the bladder 122 by introducing a limit to the narrowing of the space between the upper plate 136 and the lower plate 132.

When the bladder 122 expands, it presses against the upper plate 136 and the lower plate 132. The lower plate 132 pushes down on the load cell 124 which applies pressure to the load cell plate 130. The movement of the lower plate 132 downward expands the support springs 146. The load cell plate 130 transmits pressure generated by the bladder 122 directly to the spindle 126. The spindle 126 pushes the wafer carrier 106 with a wafer against a polishing pad for wafer polishing operations.

When the bladder 122 contracts, force applied to the upper plate 136 and the lower plate 136 is reduced so the springs 146 contract. When this occurs, the downward pressure the bladder 122 is applying is reduced which in turn reduces the downward force the spindle 126 applies to the wafer carrier 106. The reduction of pressure on the wafer carrier 106 therefore reduces polishing pressure applied to a wafer in a CMP process. Because downward force is applied in a direct line without use of a force magnifier, small adjustments applied at the bladder 122 are transmitted directly to the wafer carrier 106. The force application assembly enables stable application of pressure to the wafer at a greater range than conventional force application devices.

Figure 2D:
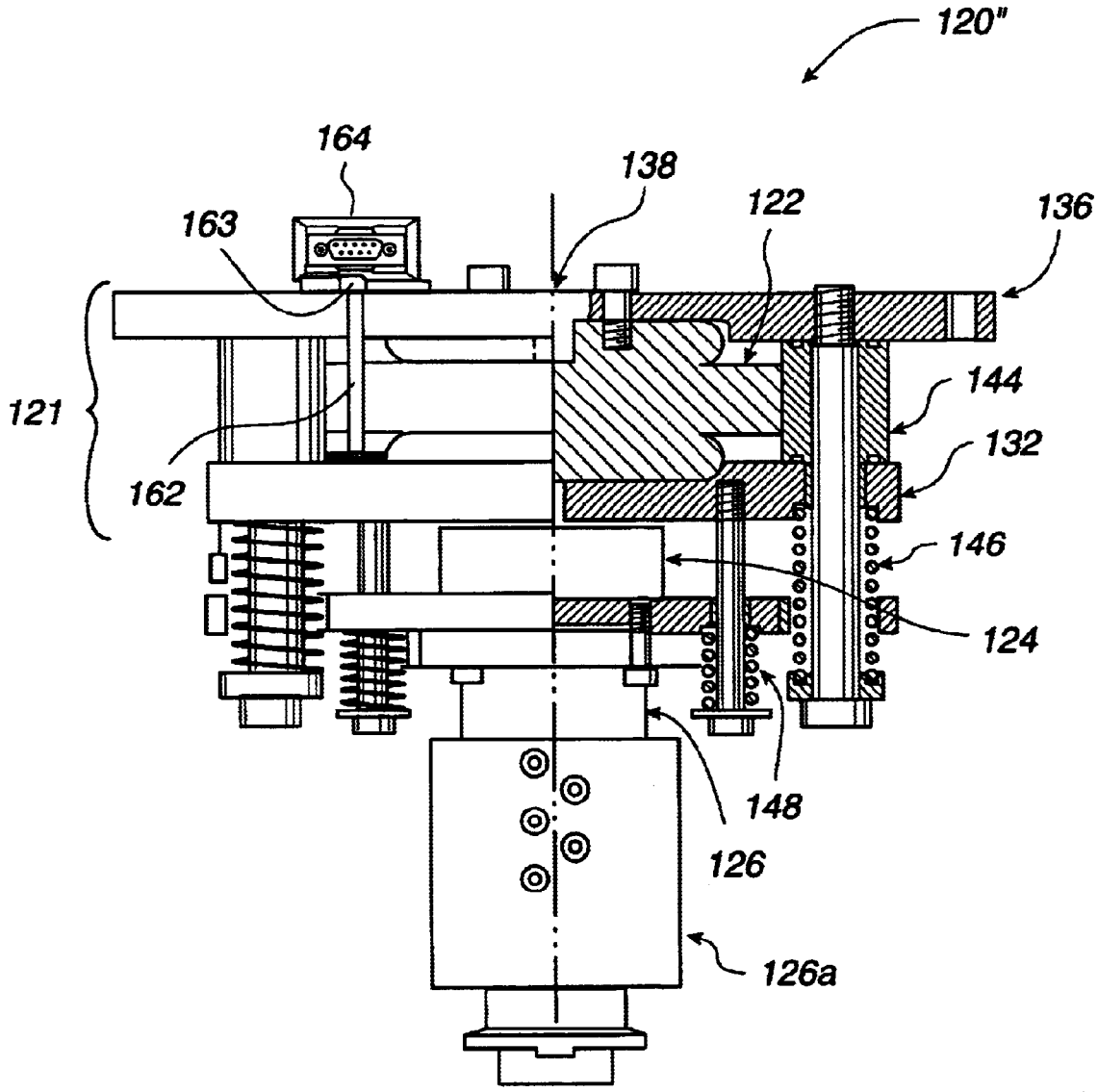
FIG. 2D includes a modified force generation assembly in accordance with one embodiment of the present invention.

FIG. 2D includes a modified force generation assembly 120" in accordance with one embodiment of the present invention. In this embodiment, the force generation assembly 120" has a structure and function of the force generation assembly 120' but has a retract flag 162 that penetrates the upper plate 136 to be coupled with the lower plate 132. The retract flag 162 may notify a pressure control system that the mechanism is retracted. A sensor located above the retract flag senses the position of the retract flag 162 and trips to indicate full retraction of the lower plate 132. In addition, the force generation assembly 120" includes a load cell amplifier output 164 which enables the servo amplifier comparator to receive an amplified load cell signal. A rotary union 126*a* may optionally be attached to the spindle 126. The rotary union 126*a* enables the spindle 126 to spin and in one embodiment allows transfer of air and/or vacuum to the carrier head. It should be understood that spindle 126 as described in the embodiments herein (as described in reference to FIGS. 2B through 3) may optionally include the rotary union 126*a*.

Figure 3:
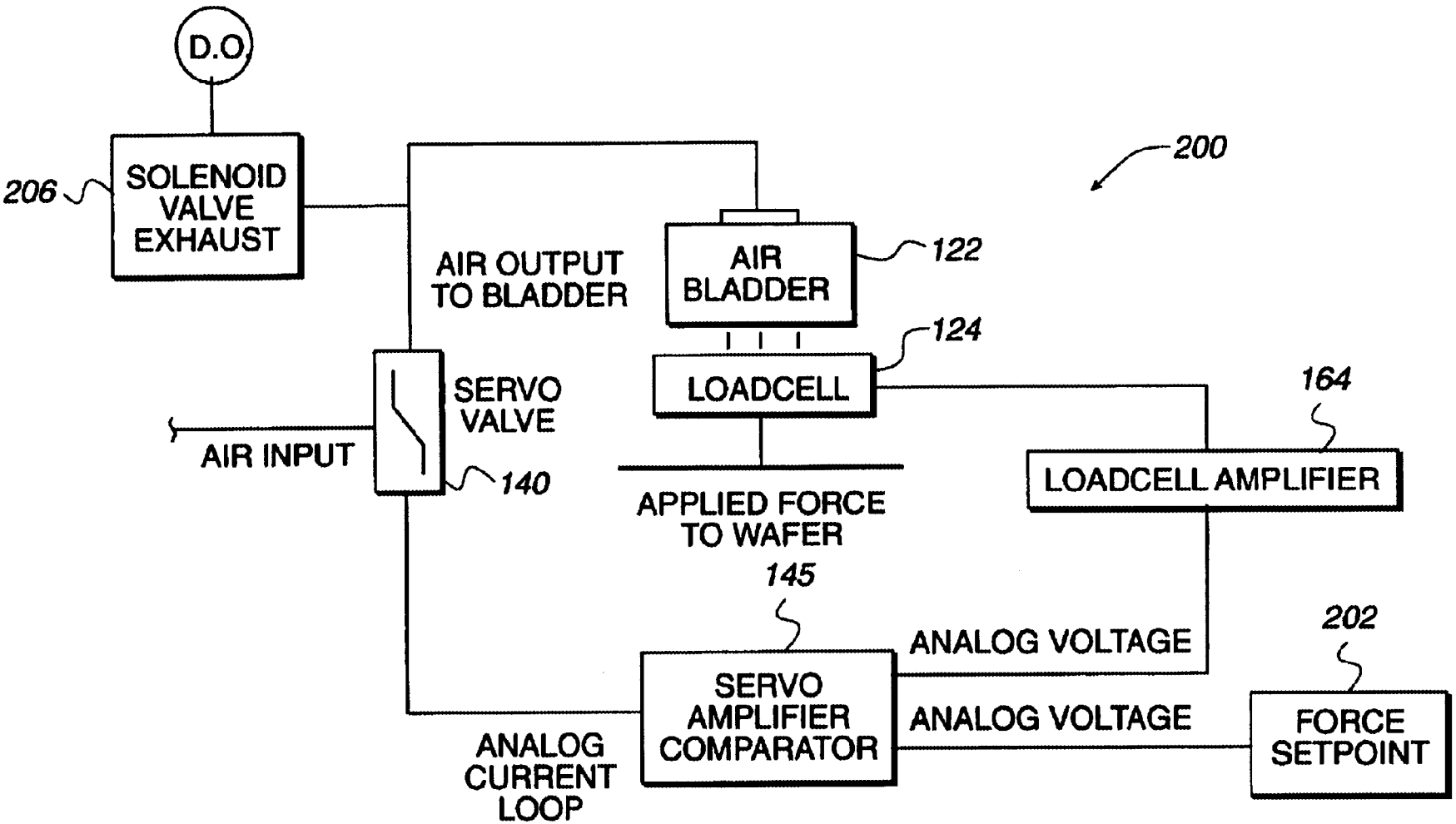
FIG. 3 shows a block diagram illustrating an operation of the force application assembly in accordance with one embodiment of the present invention.

FIG. 3 shows a block diagram 200 illustrating an operation of the force application assembly 118 in accordance with one embodiment of the present invention. In diagram 200, when air is inputted into the air bladder 122, the bladder 122 expands and pushes down on the loadcell 124. The loadcell 124 detects the force applied by the bladder 122 and sends a force measurement signal through the loadcell amplifier 164 to the servo amplifier comparator 145 indicating an amount of linear downward force detected at the loadcell 124. The signal from the loadcell 124 is low voltage so the loadcell amplifier 164 amplifies the force measurement signal. The servo amplifier comparator 145 receives the signal from the loadcell 124, which in one embodiment is an analog voltage, and utilizes a close loop monitoring of the pressure detected at the loadcell 124. The servo amplifier comparator 145 monitors signals from the load cell 124. Therefore, the servo amplifier 124 may receive the signal regarding the amount of linear downward force detected by the loadcell and compare that force with a force setpoint 202 (which in one embodiment is an analog voltage) and, by managing the servo valve 140, regulate the amount of linear downward force. In, one embodiment, the servo amplifier comparator instructs the servo valve 140 (by transmitting a signal) to channel air into the bladder 122 if the detected amount of linear downward force is below the force setpoint 202 and instructs the servo valve to release air from the air bladder when the detected downward force is higher than the force setpoint 202. An air line into the servo valve 140 may include air pressure to enable channeling of air to the bladder 122. A valve exhaust 206 is optionally attached to the system 200 which enables quicker removal of air from the air bladder 122.

In summary, the apparatus enables application of linear downward force onto a wafer carrier with a wafer thereby optimizing the ability to apply downward force for wafer polishing operations. In addition, the downward force is applied in a direct line so small adjustments applied at the bladder are transmitted directly to the wafer carrier.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims.

What is claimed is:

1. An apparatus for applying a wafer to a polishing surface during a chemical mechanical planarization (CMP) operation, comprising:

a spindle having an upper end and a lower end;

a wafer carrier coupled to the lower end of the spindle;

a linear force generator disposed at the upper end of the spindle having a bladder;

a load cell positioned between the linear force generator and the upper end of the spindle; and a controller coupled to the load cell for controlling the force applied by the linear force generator.

2. An apparatus for applying a wafer to a polishing surface during a CMP operation as recited in claim 1, wherein the linear force generator includes:

a lower plate disposed on the load cell;

an upper plate disposed above the lower plate; and the bladder positioned between the lower plate and the upper plate.

3. An apparatus for applying a wafer to a polishing surface during a CMP operation as recited in claim 2, wherein the controller includes:

a servo amplifier comparator that monitors signals from the load cell; and a servo valve that channels air into and releases air from the bladder.

4. An apparatus for applying a wafer to a polishing surface during a CMP operation as recited in claim 1, wherein a load cell plate is disposed on the upper end of the spindle, and the load cell is mounted on the load cell plate.

5. An apparatus for applying a wafer to a polishing surface during a chemical mechanical planarization (CMP) operation, comprising:

a spindle having an upper end and a lower end;

a wafer carrier coupled to the lower end of the spindle;

a load cell plate coupled to the upper end of the spindle;

a load cell disposed on the load cell plate;

a lower plate disposed on the load cell;

an upper plate supported above the lower plate; and a bladder positioned between the lower plate and the upper plate.

6. An apparatus for applying a wafer to a polishing surface during a CMP operation as recited in claim 5, further comprising:

a servo amplifier comparator that monitors signals from the load cell.

7. An apparatus for applying a wafer to a polishing surface during a CMP operation as recited in claim 6, further comprising:

a servo valve that channels fluid to and releases fluid from the bladder.

8. An apparatus for applying a wafer to a polishing surface during a CMP operation as recited in claim 7, wherein the servo amplifier comparator and the servo valve controls a force applied by the bladder.

9. An apparatus for applying a wafer to a polishing surface during a chemical mechanical planarization (CMP) operation, comprising:

a spindle having an upper end and a lower end;

a wafer carrier coupled to the lower end of the spindle;

a linear force generator disposed at the upper end of the spindle having a motor capable of providing force in a controllable manner;

a load cell positioned between the linear force generator and the upper end of the spindle; and a controller coupled to the load cell for controlling the force applied by the linear force generator.

10. An apparatus for applying a wafer to a polishing surface during a chemical mechanical planarization (CMP) operation, comprising:

a spindle having an upper end and a lower end;

a wafer carrier coupled to the lower end of the spindle;

a linear force generator disposed at the upper end of the spindle having a hydraulic device capable of providing force in a controllable manner;

a load cell positioned between the linear force generator and the upper end of the spindle; and a controller coupled to the load cell for controlling the force applied by the linear force generator.

* * * * *